US008028809B2

(12) United States Patent
Blackaby et al.

(10) Patent No.: US 8,028,809 B2
(45) Date of Patent: Oct. 4, 2011

(54) ELEVATOR SYSTEM CONTROL PROVIDING SPECIALIZED SERVICE FEATURES AND INDIVIDUAL LOCATION INFORMATION

(75) Inventors: Barry Graham Blackaby, West Simsbury, CT (US); Gary Meguerdichian, Farmington, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 12/980,561

(22) Filed: Dec. 29, 2010

(65) Prior Publication Data

US 2011/0088984 A1 Apr. 21, 2011

Related U.S. Application Data

(62) Division of application No. 11/910,272, filed as application No. PCT/US2005/012014 on Apr. 12, 2005, now Pat. No. 7,882,938.

(51) Int. Cl.
*B66B 1/34* (2006.01)

(52) U.S. Cl. ..... 187/391; 187/382

(58) Field of Classification Search ..... 187/380–389, 187/391–396, 901

See application file for complete search history.

(56) References Cited

U.S. PATENT DOCUMENTS

| | | | | |
|---|---|---|---|---|
| 4,655,324 | A | 4/1987 | Meguerdichian et al. | |
| 4,685,538 | A | 8/1987 | Kamaike | |
| 5,689,094 | A | 11/1997 | Friedli et al. | |
| 6,152,265 | A | 11/2000 | Bittar et al. | |
| 6,202,799 | B1 | 3/2001 | Drop | |
| 6,382,363 | B1 | 5/2002 | Friedli | |
| 6,425,460 | B2 | 7/2002 | Schuster | |
| 6,828,918 | B2 * | 12/2004 | Bowman et al. | 340/825.19 |
| 6,868,945 | B2 | 3/2005 | Schuster et al. | |
| 6,986,408 | B2 | 1/2006 | Takeuchi | |
| 7,377,364 | B2 | 5/2008 | Tyni et al. | |
| 7,500,544 | B2 | 3/2009 | Hakala et al. | |
| 7,717,238 | B2 | 5/2010 | Hamaji et al. | |
| 2009/0294221 | A1 | 12/2009 | Bahjat et al. | |

OTHER PUBLICATIONS

International Preliminary Report on Patentability for International application No. PCT/US05/12014, mailed May 2, 2007.

International Search Report and Written Opinion of the International Searching Authority for International application No. PCT/US05/12014, mailed Nov. 15, 2006.

* cited by examiner

*Primary Examiner* — Anthony Salata

(74) *Attorney, Agent, or Firm* — Carlson, Gaskey & Olds PC

(57) ABSTRACT

An elevator system (20) includes a transceiver (22) that receives at least one wirelessly transmitted signal (24). In one example, a signaling device (26) includes a plurality of switches (28) that can be activated to provide a signal indicating a desired or intended destination. The signal also provides an indication of the individual from whom the signal is received. A system controller (30) responds to the signal by assigning an elevator car (32) to travel to the intended destination. When the elevator car (32) is situated to receive the individual, in the event that another wireless signal is received, the system provides at least one access feature including delaying closing an elevator car door or generating an audible sound to guide the individual to the car. In one example, the system maintains information regarding expected locations of individuals providing such signals to facilitate providing assistance to them for exiting a building, for example.

13 Claims, 2 Drawing Sheets

ELEVATOR SYSTEM CONTROL PROVIDING SPECIALIZED SERVICE FEATURES AND INDIVIDUAL LOCATION INFORMATION

CROSS REFERENCE TO RELATED APPLICATIONS

This application is a divisional of U.S. patent application Ser. No. 11/910,272 filed Oct. 1, 2007, now U.S. Pat. No. 7,882,938, which is the national phase application of PCT/US05/12014, filed 12 Apr. 2005.

FIELD OF THE INVENTION

This invention generally relates to elevator systems. More particularly, this invention relates to providing specialized services for select individuals.

DESCRIPTION OF THE RELATED ART

Elevator systems use a variety of techniques for receiving calls from passengers to be carried to selected destinations. Traditionally, hall call buttons allow an individual to provide an indication that they wish to travel up or down within a building, for example. Upon arrival of an elevator car, the individual enters the car and then uses a car operating panel to provide an indication of an intended destination.

Other elevator systems use destination entry techniques that allow individuals to place a call for being carried to a specific destination using a device located outside of the elevator cars. Known techniques for assigning particular cars to carry the passengers to their intended destinations provide the advantage of increasing traffic volume capacity, for example.

One drawback associated with either of the above example techniques is that some individuals have difficulty placing a call or locating an elevator that is assigned to carry them to their intended destination. Blind or visually impaired individuals, for example, may have difficulty locating a destination entry device within a building lobby. Moreover, when a car is assigned to a particular floor the typical visual indication above the car entrance cannot be seen by such an individual and, therefore, the individual may be unable to determine which car to enter to be carried to their intended destination.

Other individuals such as the elderly or physically handicapped persons may have difficulty using a destination entry device or traditional hall call buttons.

There is a need to provide improved service to individuals requiring specialized service. Example techniques that have been proposed are shown in U.S. Pat. Nos. 4,655,324 and 6,152,265. Each of those documents disclose arrangements for assisting individuals having particularized needs when obtaining elevator service. Those skilled in the art are always striving to make improvements. For example, it would be advantageous to provide such specialized service without interrupting a destination entry dispatching technique or a channeling technique, for example.

Additionally, special concerns are presented for such individuals during emergency situations. For example, if a fire alarm is activated within a building, the elevators typically stay at the lobby level and only allow fire department personnel to operate them. Most individuals can exit the building using stairways. Blind or physically handicapped individuals may not be able to exit the building in a convenient or expeditious manner. It would be useful to provide specialized service for such individuals under such circumstances, for example.

This invention addresses the needs of elevator passengers who may have difficulty utilizing the typical passenger interface devices. Additionally, this invention provides improvements in facilitating convenient entry and exit from a building for select individuals.

SUMMARY OF THE INVENTION

One example method of controlling an elevator system includes assigning an elevator car to carry an individual to an intended destination responsive to a signal that includes an indication regarding the individual and the intended destination. In the event that a wirelessly transmitted signal is received while the assigned elevator car is situated for receiving the individual, at least one access feature is provided while the assigned elevator car is situated for receiving the individual.

In one example, the access feature comprises generating an audible tone that indicates a position of the assigned elevator car. In one example, a first audible tone is provided when the assigned elevator car arrives and becomes situated for receiving the individual. The same tone or another tone may be provided responsive to the wirelessly transmitted signal while the elevator car is so situated. This arrangement facilitates, for example, guiding an individual to a car during crowded lobby conditions when a tone that is generated upon arrival of the car may not have been heard in a manner sufficient to guide an individual to the appropriate car.

In another example, the access feature includes delaying closing a door of the assigned elevator car. This allows an individual who is having some difficulty locating the car or entering the car to generate a wirelessly transmitted signal that keeps the assigned elevator car door open, which provides the individual more opportunity to enter the appropriate car.

Another example includes providing an indication of the expected location of the individual indicated by the original signal. Such an indication can be provided, for example, on a remote emergency rescue display that is useful to fire department or other personnel for determining whether one or more individuals may still be on a particular floor within a structure during a rescue or evacuation process, for example. One example includes maintaining a database corresponding to service provided to individuals capable of providing the signal indicating who they are and their intended destination. Assuming the elevator system operates to respond to that call, an indication regarding that individual's location can be provided.

One example includes determining whether that individual has requested elevator service to another location and updating the indication of their location accordingly.

Another example method of controlling elevator system components includes assigning an elevator car to carry an individual to an intended destination responsive to a signal that includes an indication regarding the individual and the intended destination. This example method includes providing an indication that the individual was carried to the intended destination. That indication can be used, for example, by appropriate personnel to determine whether particular assistance may be needed at the corresponding destination under appropriate circumstances.

An example system for controlling elevator system components includes a controller that assigns an elevator car to carry an individual to an intended destination responsive to a signal that includes an indication regarding the individual and the intended destination. The controller in this example performs at least one other function. One example controller provides at least one access feature responsive to a wirelessly transmitted signal that is generated while the assigned elevator car is situated for receiving the individual. Another example controller provides an indication that the individual was carried to the intended destination.

The various features and advantages of this invention will become apparent to those skilled in the art from the following description of currently preferred embodiments. The drawings that accompany this description can be briefly described as follows.

DETAILED DESCRIPTION OF THE PREFERRED EMBODIMENTS

Figure 1:
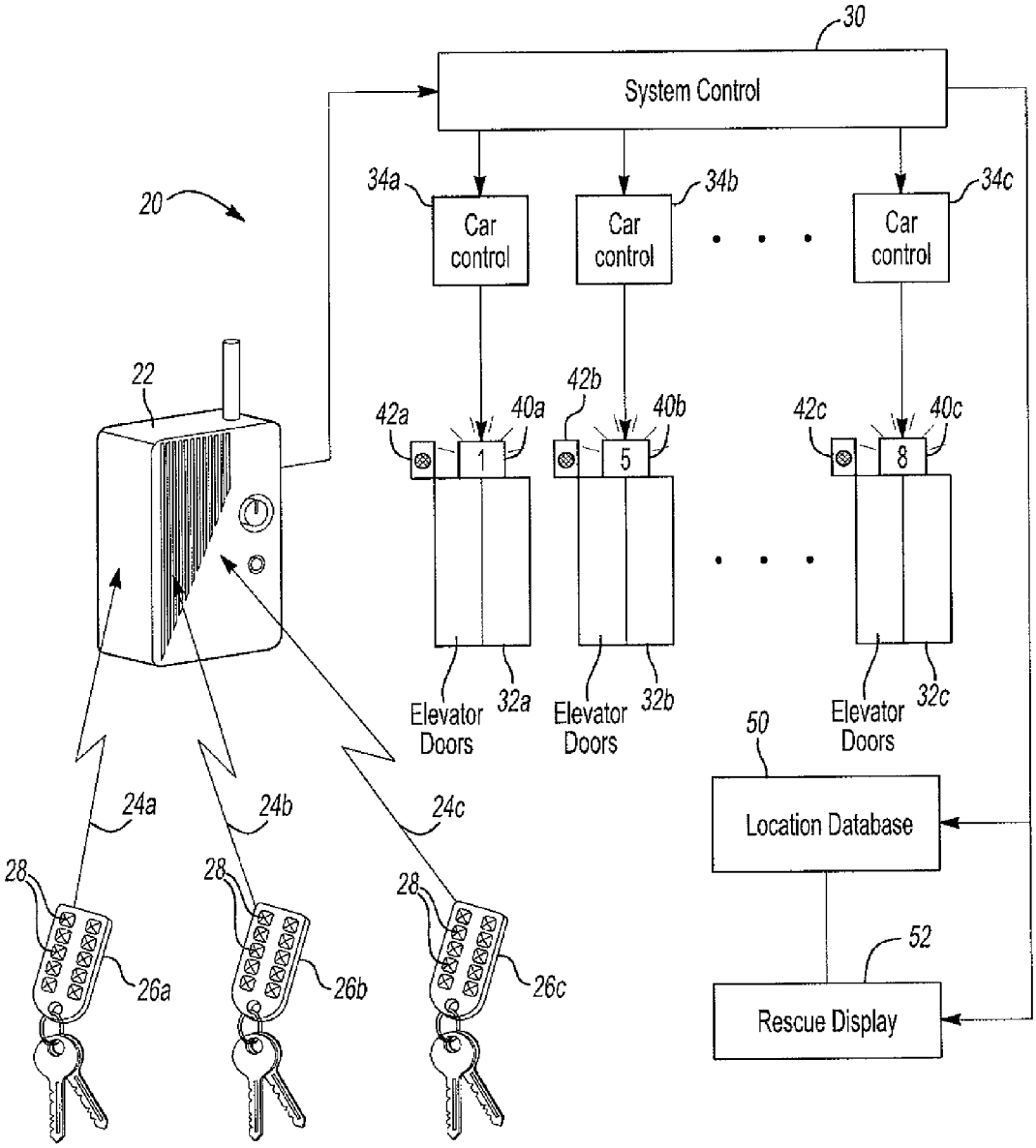
FIG. 1 schematically illustrates selected portions of an elevator system designed according to an embodiment of this invention.

FIG. 1 schematically shows selected portions of an elevator system 20. A transceiver device 22 is situated to receive one or more wirelessly transmitted signals schematically shown at 24. In the illustrated example, signaling devices 26 are useful for generating the wirelessly transmitted signals 24. Radio frequency signal transmission using known techniques is useful in one example. The signaling devices 26 may be one of a variety of known devices.

The illustrated signaling devices 26 resemble a so-called key fob and have a plurality of switches 28 that can be activated to provide a desired signal. In one example, selecting particular switches 28 or different combinations of them allows an individual to provide a signal that indicates their intended destination while the individual is outside of an elevator car, for example.

The signaling devices 26 are useful for individuals that require or desire specialized service from the elevator system 20. Examples could be blind, physically handicapped, elderly or other individuals who cannot readily utilize typical elevator system interface devices. In another example, the signaling devices 26 may be provided to individuals who receive priority service. In the illustrated example, the transceiver device 22 responds to a signal 24 and communicates information regarding that signal to a system controller 30. In this example, the system controller 30 uses known destination entry techniques for assigning at least one elevator car 32 to carry that individual to the intended destination as indicated by the wirelessly transmitted signal 24.

In one example, the signals 24 include information corresponding to an identification of the individual who is providing the signal. Each of the signaling devices 26A, for example, are assigned to particular individuals and the signals generated by those devices include a code that can be used as an indication of that individual. In this example, the controller 30 includes a look up table that associates such a code with identification information.

The illustrated example includes individual car controllers 34 that control movement of the corresponding cars 32 as directed by the system controller 30. The car controllers 34 also control indicators that provide an indication to individuals which elevator car will carry them to their intended destination. The illustrated example includes visual indicators 40 and sound generators 42. In this example, visual and audible indications are provided guiding people to the appropriate elevator car that will carry them to their intended destination. The sound generators 42 in one example are located within the elevator cars 32.

In one example, the sound generators 42 only operate responsive to an appropriate signal received from a signaling device 26. In one example, the identification information from a signaling device 26 and information regarding the intended destination are used by the controller 30 to determine the content of an audible tone or signal provided at the appropriate elevator car 32. In one example, customized tones are recognizable by individuals so that they can be confident that a particular elevator car will carry them to their intended destination. In one example, the audible indication includes a first tone corresponding to the individual's identification and a second tone corresponding to the intended destination. Using a combination of such tones allows an individual to confidently enter an elevator car feeling assured that they will be carried to their intended destination. In one example, the audible tone includes voice synthesis to guide an individual to the appropriate car.

One feature of the disclosed example is that the individual having the signaling device 26 can activate that device initially to generate a signal to place a call (i.e., to indicate their intended destination). Upon arrival of the assigned elevator car, the individual can generate another signal using the device 26 to request an access feature to assist them when entering the assigned elevator car. In one example, the access feature comprises an audible tone for guiding the individual to the car. For example, the audible tone may be generated when the assigned elevator car arrives and the door opens (i.e., the car is situated for receiving the individual). If the lobby is crowded or a physical handicap hinders the individual from quickly gaining entry to that car, generating another signal using the signaling device 26 prompts the elevator system to respond with an access feature.

One example access feature includes regenerating the tone to guide the individual to the appropriate car.

In another example, the access feature comprises delaying closing the elevator car door to provide that individual with more time to enter the car. Such an example embodiment not only allows an individual to more conveniently place a call but also allows them to request customized service at a particular time to further enhance their ability to enter an assigned elevator car, for example.

Another feature of the example of FIG. 1 is that the system controller 30 keeps a log or database regarding service provided to passengers who utilize signaling devices 26. The illustrated example includes a location database 50 that provides an indication of locations of individuals who have assigned signaling devices 26. For example, the system controller 30 determines when to assign an elevator car responsive to a signal providing an indication of an individual and their intended destination. The system controller 30 determines whether the assigned elevator car travels to the intended destination and uses that as a determination that the individual was carried to their intended destination. This information can be stored in the location database 50 for as long as desired.

In one example, the system controller 30 determines whether the same individual requests elevator car service to another destination. After an assigned elevator car responds to that request, the system controller updates the information in the database 50 regarding the expected location of that individual.

For example, when an individual requests to be carried to a particular floor at the beginning of a day and then requests to be carried to the building lobby in the evening, the system controller 30 determines that the individual has likely left the building. Under such circumstances, the indication of that individual's presence may be deleted from the location database 50. Alternatively, the location database 50 includes information regarding the expected location of all individuals having signaling devices 26 over a selected period of time, such as the previous 24 hours, for example. Maintaining such information provides enhanced abilities to service such individuals when they may need assistance exiting a building, for example.

Such a feature is useful, for example, to rescue personnel such as fire department personnel. In this example, a remote emergency rescue display 52 can be used by building managers or fire department personnel, for example. Utilizing the techniques of the disclosed example, particularized information regarding particular individuals can be provided on the display 52 to ensure more convenient and reliable service to any individual that may require particular assistance when attempting to leave a building under such circumstances. The information from the location database 50 provides information, for example, regarding a physically handicapped individual's location and information that they are unable to utilize a stairway to leave that building level. This enables fire department or other personnel to potentially address the need to assist that individual to leave a building with appropriate priority.

One example system includes a plurality of transceiver devices 22 positioned strategically throughout a building so that the signals 24 can be recognized by the system on any level within the building. One example includes at least one receiver strategically positioned on each level of a building. Another example includes receivers positioned at various locations within a building sufficient to ensure that a signal transmitted by one of the devices 26 will be recognized provided that the device 26 is within range inside of the building structure.

Another example includes the ability for an individual to utilize one or more of the switches 28 on their signaling device 26 to place a request for assistance. This may be useful, for example, when the individual is having difficulty accessing an elevator at a particular location. The system 20 provides an indication that such a request has been made so that security personnel or another authorized individual can respond to such a request. Based on the location of the receiver 22 that receives such a signal and information from the location database 50, the system is able to direct an appropriate individual to the expected location of the person requesting such assistance.

Figure 2:
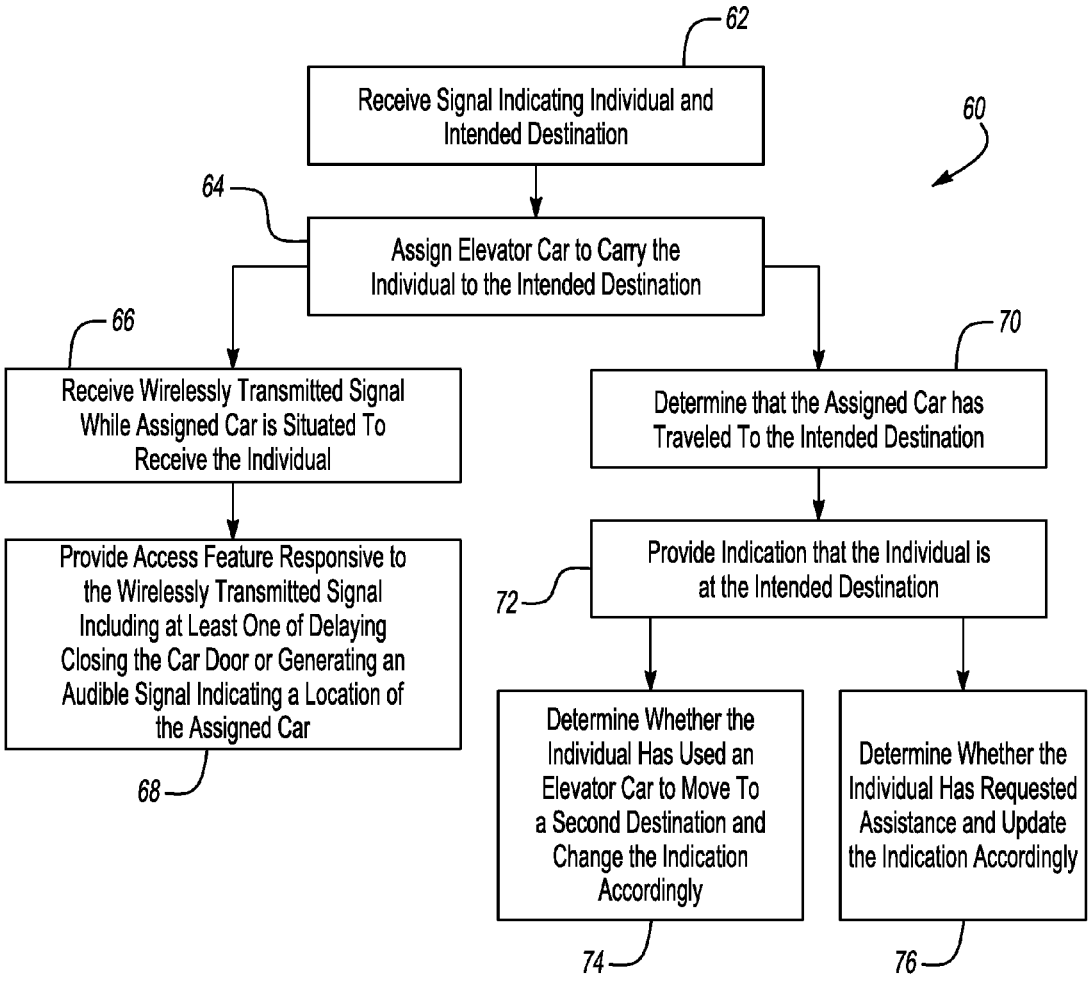
FIG. 2 is a flowchart diagram summarizing control strategies useful in an example embodiment.

The disclosed arrangement of FIG. 1 may operate to provide one or more of the features described above. FIG. 2 includes a flowchart diagram 60 that summarizes possible operation of such an example arrangement. At 62, the system receives a signal indicating the individual and their intended destination. Such a signal may be wirelessly transmitted or may be manually entered using a destination entry device, for example. At 64, the system assigns an elevator car to carry the individual to their intended destination. In one example, upon arrival of the assigned elevator car, a specialized indication is provided to guide the individual to that car. If a wirelessly transmitted signal is received at 66 while the assigned car is situated to receive the individual, the system responds at 68 by providing an access feature. One example access feature includes delaying closing the car door. Another access feature includes generating an audible signal indicating a location of the assigned car, which may also provide information regarding that individual and the intended destination.

Even if no wirelessly transmitted signal is received at 66, in the example of FIG. 2, the system determines that the assigned car has traveled to the intended destination at 70. At 72, the system provides an indication that the individual is at the intended destination. Subsequently, the system determines at 74 whether the individual has used an elevator car to move to a second destination and changes the indication accordingly. In the example of FIG. 2, the system has the capability of determining at 66 whether the individual has requested assistance and provides an indication of such a request to facilitate providing such assistance.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of controlling elevator system components, comprising the steps of:

(A) assigning an elevator car to carry an individual to an intended destination responsive to a signal that includes an indication regarding the individual and the intended destination;

(B) receiving a wirelessly transmitted signal from a first device while the assigned elevator car is situated for receiving the individual;

(C) providing at least one access feature responsive to the wirelessly transmitted signal while the assigned elevator car is situated for receiving the individual; and (D) providing an indication on a second, different device that the individual was carried to the intended destination for facilitating subsequently identifying an expected location of the individual.

2. The method of claim 1, wherein the access feature comprises an audible tone indicating a position of the assigned elevator car.

3. The method of claim 2, including providing a first audible tone when the assigned elevator car becomes situated for receiving the individual and subsequently providing the audible tone of step (C).

4. The method of claim 2, wherein the audible tone comprises an indication of the intended destination.

5. The method of claim 1, wherein step (C) includes delaying closing a door of the assigned elevator car.

6. The method of claim 1, including generating an audible tone to correspond to the indicated individual and the intended destination when the assigned elevator car becomes situated for receiving the individual.

7. The method of claim 1, including determining whether the individual has requested an elevator car to travel to a second destination and changing the indication to indicate the second destination if an elevator car has traveled responsive to the request.

8. The method of claim 1, including providing the indication on a visual display of the second device.

9. The method of claim 1, including providing an indication on the second device of a received request for assistance from the individual.

10. The method of claim 1, comprising using the indication during an emergency situation.

11. The method of claim 1, comprising maintaining a database of expected locations of individuals for facilitating subsequently providing assistance to at least one of the individuals at the corresponding expected location.

12. A method of controlling elevator system components, comprising the steps of:

assigning an elevator car to carry an individual to an intended destination responsive to a signal that includes an indication regarding the individual and the intended destination;

receiving a wirelessly transmitted signal from a first device while the assigned elevator car is situated for receiving the individual;

providing at least one access feature responsive to the wirelessly transmitted signal while the assigned elevator car is situated for receiving the individual;

providing an indication on a second, different device that the individual was carried to the intended destination; and determining whether the individual has requested an elevator car to travel to a second destination and changing the indication to indicate the second destination if an elevator car has traveled responsive to the request.

13. A method of controlling elevator system components, comprising the steps of:

assigning an elevator car to carry an individual to an intended destination responsive to a signal that includes an indication regarding the individual and the intended destination;

receiving a wirelessly transmitted signal from a first device while the assigned elevator car is situated for receiving the individual;

providing at least one access feature responsive to the wirelessly transmitted signal while the assigned elevator car is situated for receiving the individual;

providing an indication on a second, different device that the individual was carried to the intended destination; and maintaining a database of expected locations of individuals based upon the intended destination of each of the individuals for facilitating subsequently providing assistance to at least one of the individuals at the expected location.

* * * * *